US007063590B2

(12) United States Patent
Ferrigno

(10) Patent No.: US 7,063,590 B2
(45) Date of Patent: Jun. 20, 2006

(54) DOLL HAVING ADJUSTABLE LENGTH HAIR

(75) Inventor: Al Ferrigno, Floral Park, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/945,385

(22) Filed: Sep. 20, 2004

(65) Prior Publication Data

US 2006/0063468 A1 Mar. 23, 2006

(51) Int. Cl.
*A63H 3/44* (2006.01)

(52) U.S. Cl. ..... 446/319; 446/394

(58) Field of Classification Search ..... 446/319, 446/394, 330, 352, 353, 268, 129, 130
See application file for complete search history.

(56) References Cited

U.S. PATENT DOCUMENTS

| | | | | |
|---|---|---|---|---|
| 2,537,536 | A | 1/1951 | Lilienstem | |
| 2,709,220 | A | 5/1955 | Spector | |
| 2,741,870 | A | 4/1956 | Lang | |
| 2,789,393 | A | 4/1957 | Cooke | |
| 3,156,999 | A | 11/1964 | Dean et al. | |
| 3,162,976 | A * | 12/1964 | Beebe et al. | 446/319 |
| 3,253,799 | A | 5/1966 | Till | |
| 3,535,818 | A | 10/1970 | Pajak | |
| RE27,267 | E | 1/1972 | Lilienstem | |
| 3,670,451 | A * | 6/1972 | Groves et al. | 446/319 |
| 3,691,679 | A | 9/1972 | Kersten | |
| 3,694,957 | A * | 10/1972 | Houghton | 446/319 |
| 3,696,551 | A * | 10/1972 | Sklarsky et al. | 446/319 |
| 3,698,134 | A * | 10/1972 | Amici et al. | 446/319 |
| 3,704,542 | A * | 12/1972 | Suchowski | 446/319 |
| 3,728,906 | A | 4/1973 | Takaki et al. | |
| 3,808,736 | A | 5/1974 | Terzian et al. | |
| 3,812,613 | A | 5/1974 | Glass et al. | |
| 3,834,071 | A * | 9/1974 | Terzian et al. | 446/353 |
| 4,170,085 | A * | 10/1979 | Luke | 446/319 |
| 4,246,722 | A | 1/1981 | Sapkus et al. | |
| 4,259,807 | A | 4/1981 | Silverstein | |

(Continued)

FOREIGN PATENT DOCUMENTS

EP 537924 A1 4/1993

(Continued)

*Primary Examiner*—Kien Nguyen
(74) *Attorney, Agent, or Firm*—Akin Gump Strauss Hauer & Feld, LLP

(57) ABSTRACT

A toy doll has a doll head having an aperture and a doll body supporting the doll head. A tubular member has a first end extending into the doll head proximate the aperture and a second end extending into the doll body. A plug member is movable within the tubular member either toward the first end or toward the second end. A lock of doll hair is secured to the plug member so that at least a portion of the lock of doll hair extends out of the tubular member and out of the head aperture. An electric motor within the doll body includes an output shaft rotatable in first and second directions. A movement assembly interconnects the plug member and the output shaft of the motor so that when the output shaft rotates in the first direction, the plug member moves toward the first end of the tubular member to move a length of a lock of hair out of the head aperture, and when the output shaft rotates in the second direction, the plug member moves toward the second end of the tubular member to withdraw a length of the lock hair into the head aperture.

18 Claims, 7 Drawing Sheets

U.S. PATENT DOCUMENTS 4,323,902 A 4/1982 Hussey et al.
4,622,021 A 11/1986 Darrigo
4,633,266 A 12/1986 Alf et al.
4,665,406 A 5/1987 Takizawa et al.
4,682,968 A 7/1987 Droller et al.
4,801,286 A * 1/1989 Orenstein et al. ..... 446/319
4,802,878 A * 2/1989 Terzian et al. ..... 446/300
4,828,528 A 5/1989 Chatkis
4,917,647 A 4/1990 Wetherell et al.
5,019,834 A 5/1991 Suga
5,029,214 A 7/1991 Hollander
5,037,345 A 8/1991 Nakayama
5,067,924 A 11/1991 Munter
5,073,140 A 12/1991 Lebensfeld et al.
5,087,219 A 2/1992 Price
5,116,277 A * 5/1992 Kelley ..... 446/319
5,125,865 A 6/1992 Orenstein et al.
5,129,853 A 7/1992 Bowling
5,149,288 A 9/1992 Kelley
5,155,496 A 10/1992 Suga
5,290,198 A 3/1994 Nakayama
5,376,038 A 12/1994 Arad et al.
5,415,580 A 5/1995 Ferri
5,507,678 A 4/1996 Chiang
5,607,336 A 3/1997 Lebensfeld et al.
6,016,038 A 1/2000 Mueller et al.
6,048,209 A 4/2000 Bailey
6,135,847 A 10/2000 Coates
6,139,397 A * 10/2000 Blau et al. ..... 446/319
6,149,490 A 11/2000 Hampton et al.
6,150,774 A 11/2000 Mueller et al.
6,239,754 B1 5/2001 Kim
6,244,926 B1 6/2001 George et al.
6,257,948 B1 7/2001 Silva
6,293,866 B1 9/2001 Walker et al.
6,337,671 B1 1/2002 Lee
6,413,142 B1 7/2002 Weastler
6,471,565 B1 10/2002 Simeray
6,554,679 B1 4/2003 Shackelford et al.
6,609,943 B1 8/2003 Chan
6,641,455 B1 11/2003 Chan
6,719,604 B1 4/2004 Chan
2001/0041495 A1 11/2001 Chan
2003/0220044 A1 11/2003 Andrews et al.
2004/0127140 A1* 7/2004 Kelly et al. ..... 446/268

FOREIGN PATENT DOCUMENTS

FR 1369752 7/1964
FR 2411618 7/1979
FR 2508812 1/1983
WO WO 02/09834 A2 2/2002

* cited by examiner

DOLL HAVING ADJUSTABLE LENGTH HAIR

BACKGROUND OF THE INVENTION

The present invention relates generally to toy dolls and, more particularly, to a toy doll which includes hair, the length of which is adjustable by a user in an automated manner.

Toy dolls having adjustable length hair are well known in the prior art. U.S. Pat. No. 4,801,286 discloses a toy doll including a doll body and head having an aperture through which a lock of hair passes. One end of the doll's hair is captured in a plug or cup which moves inwardly and outwardly through a tubular sleeve under the influence of a biasing spring and mechanical retracting mechanism. Movement of the arms of the doll by a user causes a spool within the doll to rotate in either a clockwise direction pulling the hair back into the head or a counter clockwise direction whereupon the bias of the spring pushes the hair out of the doll head.

U.S. Pat. Nos. 3,698,134; 3,834,071; 4,170,085; and 5,116,277 each disclose toy dolls having heads on torso portions with an opening in the head portion from which extends a lock of hair. In each of these patents, the lock of hair is adapted to be pulled by a user out of the opening in the doll head to simulate the growth of hair. The interior portion of the lock of hair is secured to a cord or similar member which in turn is wound around a spool or similar member. The spool rotates in a first direction to permit the lock of hair to be pulled outwardly simulating the growth of the doll's hair. Manually rotating the spool in the opposite direction retracts the lock of hair into the doll's head to shorten the length of the doll's hair.

U.S. Pat. Nos. 3,670,451; 3,694,957; 4,917,647; and 6,139,397 each disclose a toy doll similar to the dolls discussed above in which a lock of hair may be pulled outwardly by a user to simulate the growth of the doll's hair. In the case of these four patents, pulling the hair outwardly results in the tensioning of a spring or other biasing member. When the user actuates a release mechanism, the spring or other biasing member automatically retracts the lock of hair into the head.

The present invention comprises an improvement over the above-described prior art dolls. A toy doll in accordance with the present invention includes an electric motor within the doll body operatively connected to a movement assembly for moving a lock of hair in or out of a head aperture. A switch is provided on the doll head for controlling the operation of the electric motor to either extend or retract the lock of hair. Further details of the structure and operation of the present invention will hereinafter become apparent.

BRIEF SUMMARY OF THE INVENTION

Briefly stated, the present invention comprises a toy doll which includes a doll head having an aperture extending therethrough and a doll body supporting the doll head. The toy doll further includes a tubular member having a first end extending into the doll head proximate the aperture and a second end extending into the doll body. A plug member is provided within the tubular member, the plug member being movable toward the first end or toward the second end of the tubular member. A lock of doll hair is secured to the plug member so that at least a portion of the lock of hair extends out of the first end of the tubular member and out of the head aperture. An electric motor is provided within the doll body.

The motor has an output shaft rotatable in first and second directions. A movement assembly interconnects the plug member and the output shaft of the motor so that when the output shaft rotates in a first direction, the plug member moves toward the first end of the tubular member to move a length of the lock of hair out of the head aperture and when the output shaft rotates in the second direction, the plug member moves toward the second end of the tubular member to withdraw a length of the lock of hair into the aperture. In the preferred embodiment, a switch-controlled actuator is provided to permit a user to select whether to extend or retract the lock of hair.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 5:
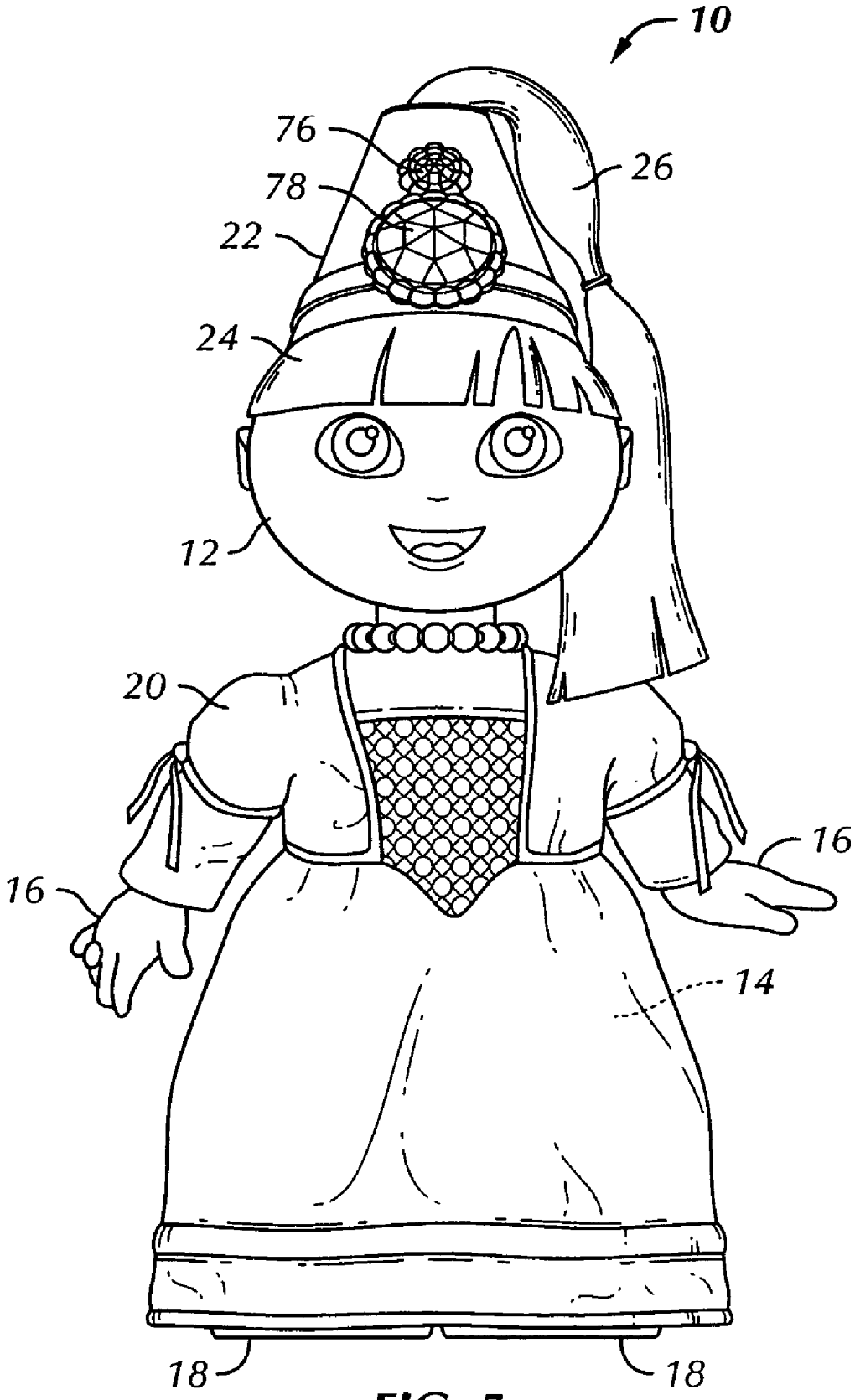
FIG. 5 is a front elevational view of the completed doll of FIG. 1
Figure 6:
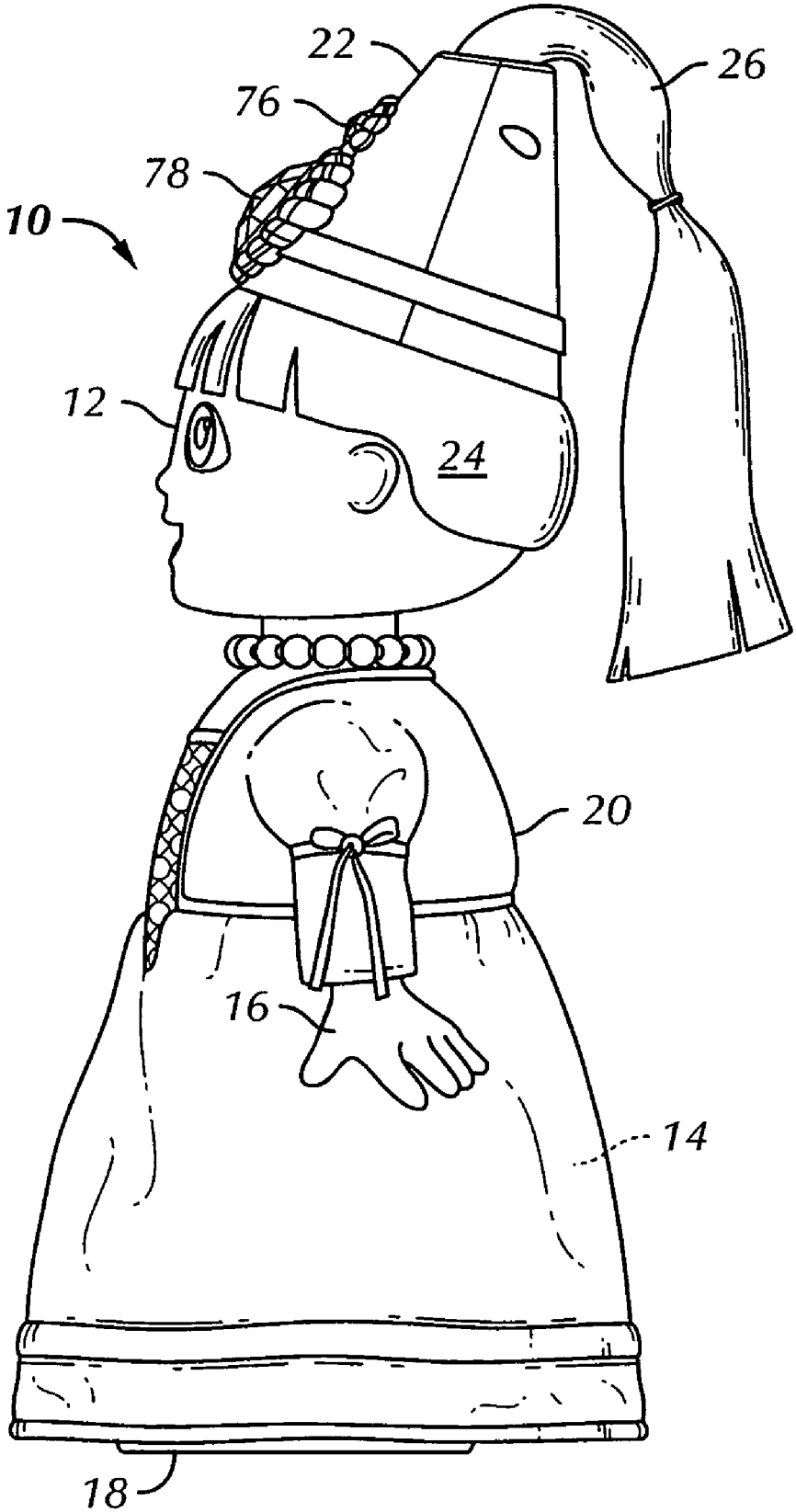
FIG. 6 is a side elevational view of the doll of FIG. 5 showing the lock of hair in a retracted position.
Figure 7:
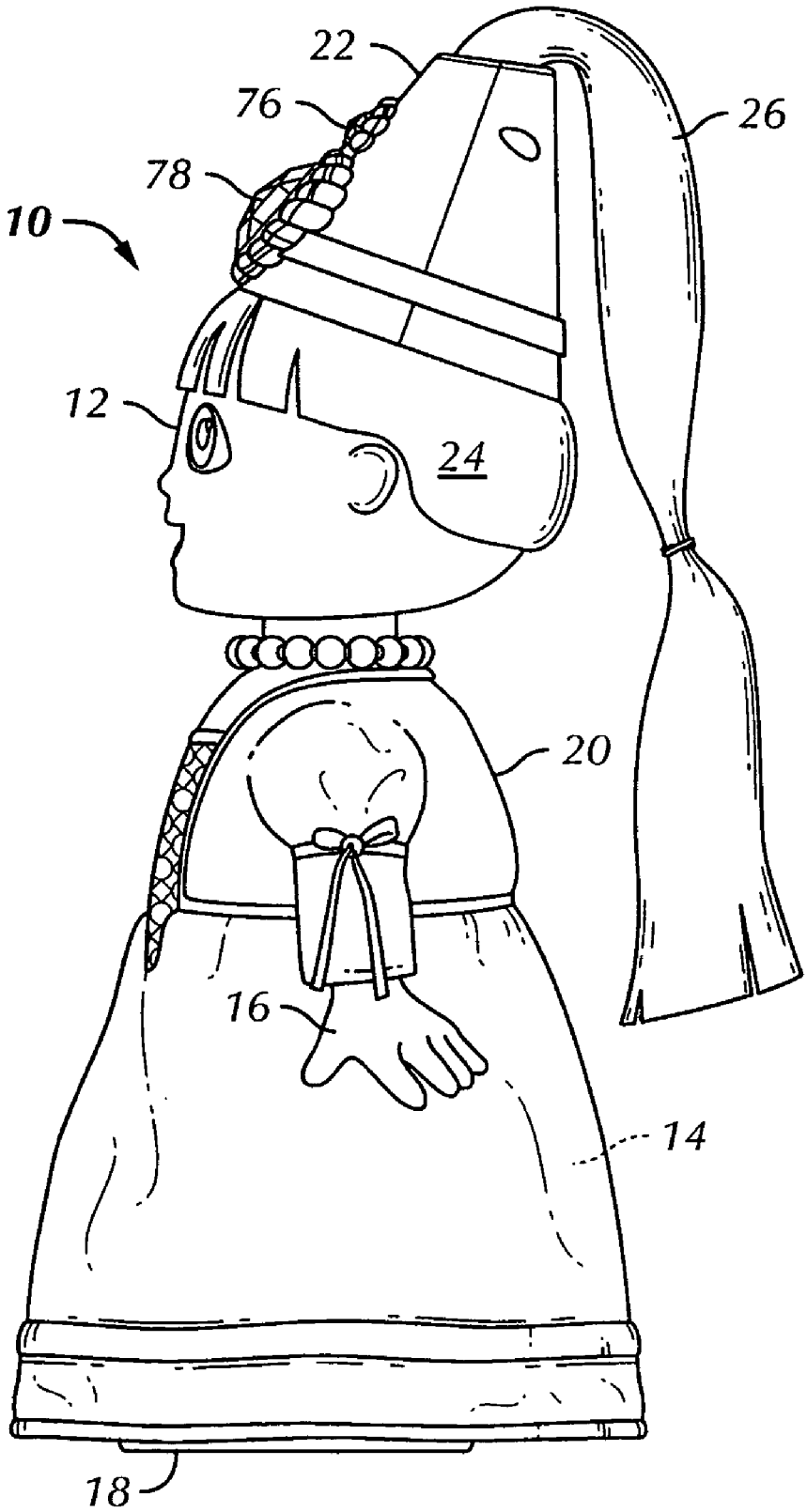
FIG. 7 is a side elevational view of the doll of FIG. 5 showing the lock of hair in the extended position.

Referring to the drawings, wherein the same numerals are used for indicating the same elements throughout the several figures, there is shown in FIGS. 5–7 a toy doll 10 in accordance with the present invention. The toy doll 10 includes a doll head 12 and a doll body 14. As shown in FIGS. 5–7, the toy doll 10 further includes arms 16, feet 18, clothing such as a dress 20, and a hat or other headpiece 22. The doll head 12 is adorned with eyes, a nose, a mouth, ears, etc., to simulate the appearance of a person. The doll head 12 further includes hair 24 including a lock of hair 26 extending out of an aperture (not shown on FIGS. 5–7) extending through the doll head 12. As can be seen from a comparison of FIGS. 6 and 7, the lock of hair 26 is movable between a retracted position (FIG. 6) and an extended position (FIG. 7). The toy doll 10 as thus far described is typical of virtually any type of toy doll which include a lock of hair 26 which is extendable or retractable. It will be appreciated by those of ordinary skill in the art that the present invention is not limited to a doll having a particular facial appearance, dress, headpiece, hair style, or the like. Accordingly, the doll 10, as thus far shown and described, is but one embodiment employed only for the purpose of illustrating the structure and operation of the present invention.

Figure 1:
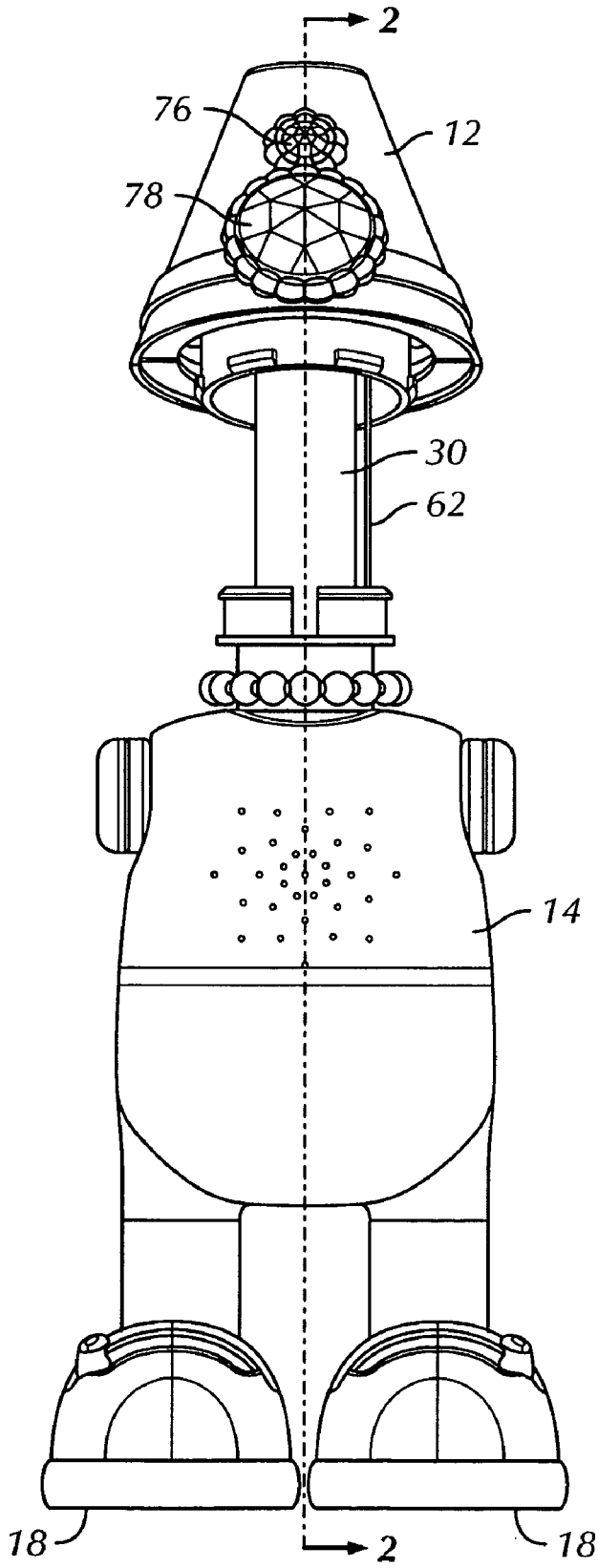
FIG. 1 is a front elevational view of the structural portion of a toy doll in accordance with a preferred embodiment of the present invention.
Figure 2:
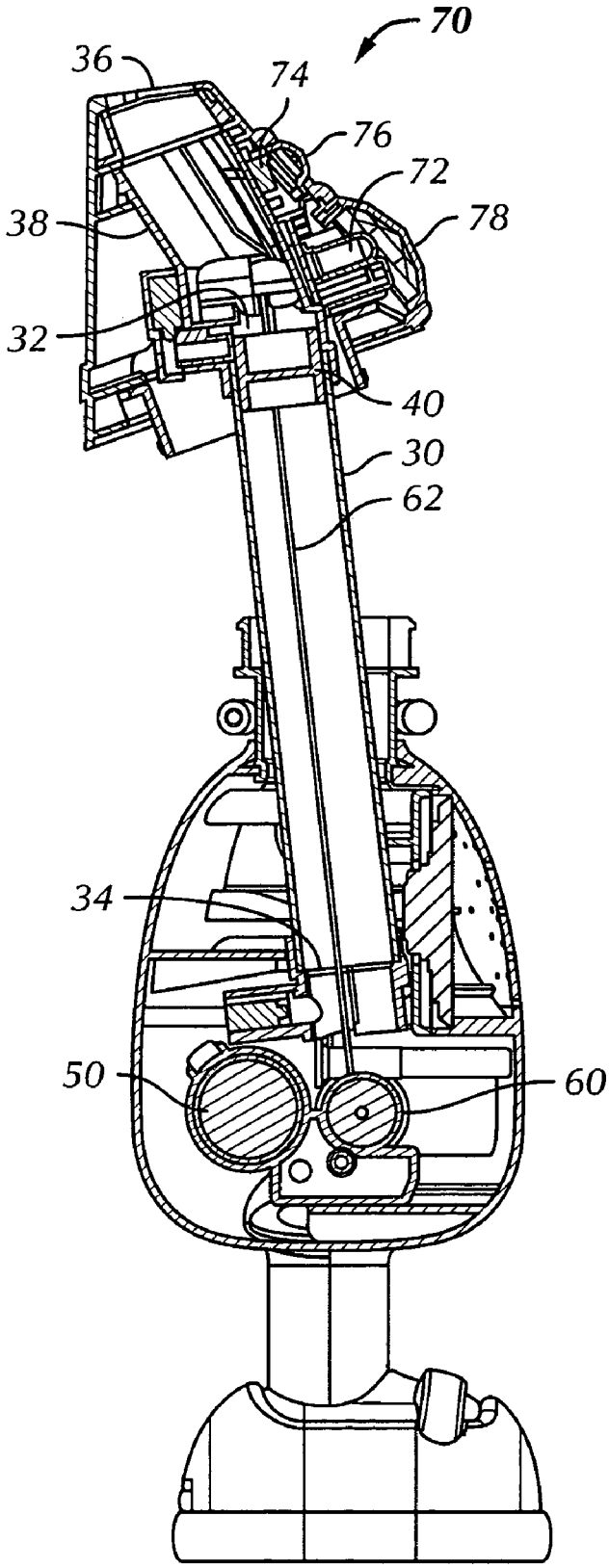
FIG. 2 is a sectional view of the toy doll taken along lines 2—2 of FIG. 1.
Figure 3:
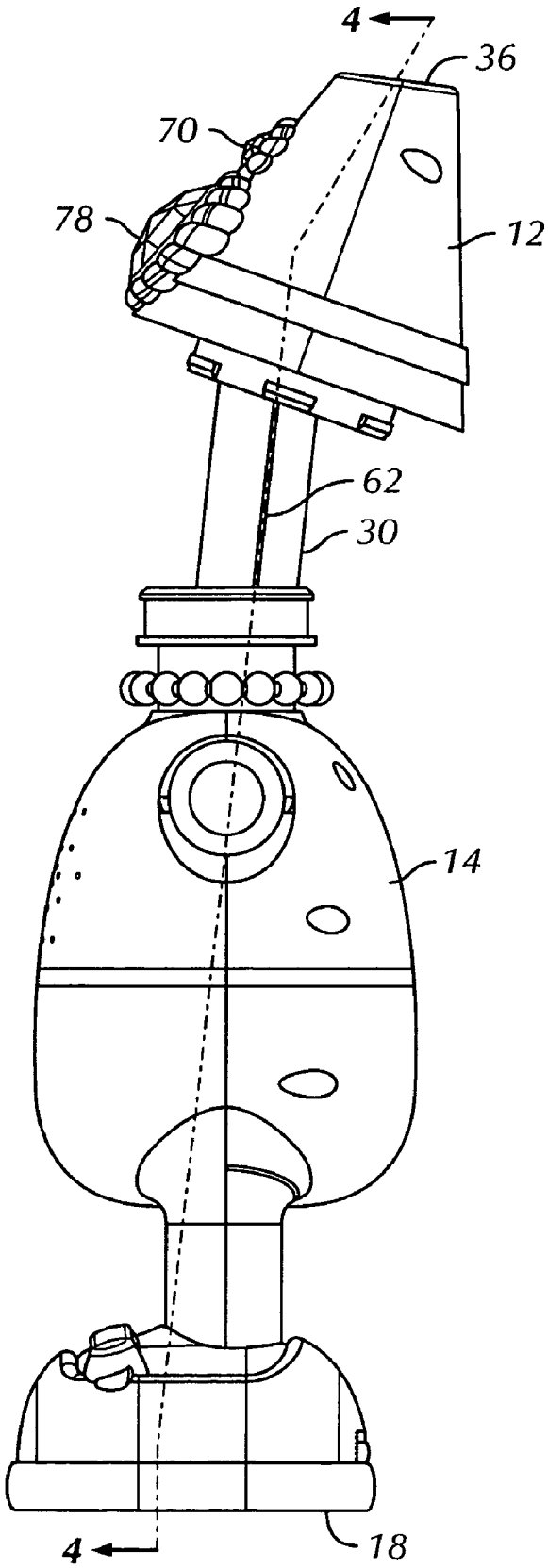
FIG. 3 is a left side elevational view of the toy doll of FIG. 1.
Figure 4:
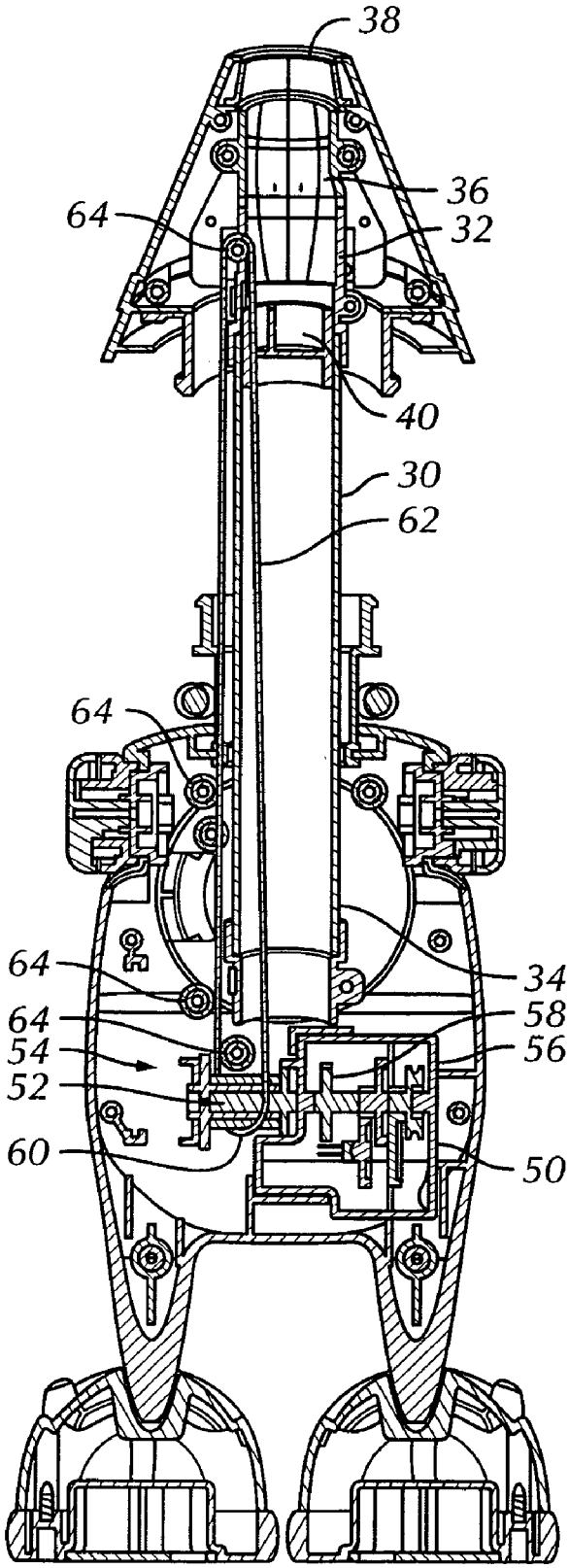
FIG. 4 is a sectional view of the toy doll taken along lines 4—4 of FIG. 3

Referring now to FIGS. 1–4, there is shown in greater detail the interior structure of the toy doll 10. As shown, the toy doll 10 further includes a tubular member 30 extending from the doll body 14 for supporting the doll head 12. As best shown in FIG. 2, the tubular member 30 has a first end 32 extending upwardly into the doll head 12 and a second end 34 which extends downwardly into the doll body 14. The tubular member 30, doll head 12 and doll body 14 are preferably made from a generally rigid, preferably polymeric material of a type known to those skilled in the toy doll art. It will be apparent to those of ordinary skill in the art that other materials, particularly polymeric materials, may alternatively be employed. As best shown in FIGS. 2 and 4, the doll head 12 includes an opening or aperture 36 on its upper surface and a passageway 38 extending generally between the first tubular member end 32 and the aperture 36. As will become apparent, the lock of hair 26 extends through the passageway 38 and out of the aperture 36 within the doll head 12.

Referring now to FIGS. 2 and 4, a plug member 40 is located within the tubular member 30. The plug member 40 is generally cylindrically shaped and has an outside diameter which is slightly less than the inside diameter of the tubular member 30. In this manner, the plug member 40 is movable within the tubular member 30 toward the first tubular member end 32 or toward the second tubular member end 34 in a manner similar to that of a piston. A first end of the lock of hair 26 is secured to the plug member 40 with the lock of hair 26 extending through the passageway 38 and out of the aperture 36 in the doll head 12. In this manner, movement of the plug member 40 toward the first tubular member end 32 results in more of the lock of hair 26 being moved out of the aperture 36 to provide for longer hair as shown in FIG. 7. Correspondingly, movement of the plug member 40 toward the second tubular member end 34 results in more of the lock of hair 26 being drawn into the doll head 12 through the aperture 36 to shorten the length of the exposed lock of hair 26 as shown in FIG. 6. Movement of the plug member 40 in either direction along the tubular member 36 is controlled by the user in a manner which will hereinafter be described. Preferably, the plug member 40 is also made of a rigid, preferably polymeric material which is compatible for movement along the interior of the tubular member 30.

As previously mentioned, the movement of the lock of hair 26 into and out of the doll head 12 is accomplished in an automated manner. Preferably, the doll body 14 includes a small electric motor 50 of the sub horsepower type and a suitable power source such as a battery or plurality of batteries (not shown). The electric motor 50 which is of the reversible type includes an output shaft 52 which is rotatable in either a first direction or a second direction depending upon the polarity of the power applied. The motor output shaft 52 is connected to a movement assembly 54. In the present embodiment, the movement assembly 54 includes a suitable transmission 56 comprised of a plurality of drive gears 58, a reel member 60, which is a horizontally oriented capstan driven to rotation by the drive gears 58, and a flexible line 62. In the present embodiment, the drive gears 58 and reel member 60 are made from a generally rigid, preferably polymeric material of a type well known to those of ordinary skill in the toy doll art. The flexible line 62 is preferably comprised of a woven steel cable but could be other cordage or flexible coupler including chain, comprised of any other suitable material, if desired. The frictional coupling between the reel member 60 and flexible line 62 is preferred as it effectively provides a clutching action which permits the hair to be withdrawn from the doll head 12 and continuous running of the motor 50 at the ends of travel of the plug member without damage and without requiring special reinitialization.

As best shown in FIGS. 2 and 4, the flexible line 62 is comprised of a generally endless loop which at least partially surrounds and engages the reel member 60, extends upwardly along the interior and exterior of the tubular member 30 and is secured to the plug member 40. The portion of the flexible line 62 which extends outside of the tubular member 30 engages a plurality of guide rollers 64. In this manner, when power is supplied to the electric motor 50 such that the output shaft 52 rotates in a first direction, the drive gears 58 of the transmission 56 cause the reel member 60 to rotate in a first direction causing the endless loop flexible line 62 to similarly rotate in a first direction to thereby move the attached plug member 40 upwardly along the tubular member 30 toward the first end 32. As the plug member 40 is moved toward the first tubular member end 32, the lock of hair 26 moves through the passageway 38 and out of the aperture 36 in the doll head 12 to thereby lengthen the exposed portion of the lock of hair 26 as shown in FIG. 7. Similarly, when power is applied to the electric motor 50 to cause the output shaft 52 to rotate in the second direction, the drive gears 58 of the transmission 56 in turn cause the reel member 60 to rotate in the second direction to thereby rotate the endless loop flexible line 62 in the second direction to move the attached plug member 40 downwardly along the tubular member 30 toward the second end 34. Movement of the plug member 40 toward the second tubular member end 34 causes the lock of hair 26 to be drawn inwardly through the doll head aperture 36 to thereby shorten the exposed portion of the lock of hair 26 as shown in FIG. 6. It will be appreciated by those of ordinary skill in the art that other components or techniques may be employed for moving the plug member 40 up and down along the tubular member 30 to extend or retract the exposed portion of the lock of hair 26. For example, instead of employing a reel member 60 and endless flexible line 62, a telescoping member and/or a more resilient flexible line fed from and rewound on a reel similar to those described, for example, in U.S. Pat. Nos. 3,253,799, 4,323,902 and 4,665,406 incorporated by reference herein, that are employed in connection with and extending or retracting radio antenna on a vehicle may alternatively be employed. Those skilled in the art will appreciate that connecting the plug member 40 to a telescoping antenna-like member will result in movement of the plug member 40 upwardly or downwardly along the tubular member 30 to extend or retract the lock of hair 26. Further, the movement assembly 54 could include a rack and pinion or other such component for converting the rotational motion of the motor output shaft 52 into translational motion from moving the plug member 40 along the tubular member 30. Other movement assemblies will be apparent to those of ordinary skill in the art. It should therefore be clearly understood that the present invention is not limited to the particular movement assembly 54 as shown and described.

The toy doll 10 further includes an actuator 70 for controlling the operation of the electric motor 50 to cause the output shaft 52 to rotate in either the first direction or the second direction. The actuator 70, in the present embodiment, comprises first and second switches 72, 74 which are preferably located behind the two decorative members 76, 78 located on the headpiece 22 of doll head 14. In the present embodiment, the first switch 72 is in engagement with the second decorative member 78 and is of the momentary push-button type. The first switch 72 is employed for controlling the polarity of the power supplied to the electric motor 50 to thereby control the direction of movement of the output shaft 52. Thus, a user depressing the second decorative member 78 actuates the first switch 72 to change the direction of rotation of the motor output shaft 52 which, as described above, determines whether the exposed portion of the lock of hair 26 is lengthened or shortened. In the present embodiment, the second switch 74 is located proximate to the first decorative member 76 and is of the magnetic reed type. Preferably, the toy doll 10 includes an accessory, such as a comb, hair brush, "magic wand", etc. (none shown), which contains a magnet therein. Thus, whenever the accessory is placed near the first decorative member 76, the magnetic reed switch 74 is actuated to supply power to the electric motor 50. The electric motor 50 then functions to cause the output shaft 52 to rotate in whichever direction has been established by actuation of the first switch 72. The electric motor output shaft 52 continues to rotate to either extend or retract the exposed portion of the lock of hair 26 as long as the magnet in the accessory is maintained in the portion of the first decorative member 76 to keep the magnetic reed switch 74 closed. Removing the accessory opens the magnetic reed switch 74 to stop further lengthening or shortening of the exposed portion of the lock of hair 26. Alternatively, the second switch 74 could comprise a momentary contact or other such switch such that when the decorative member 76 is depressed by a user, power is supplied to the electric motor 50. Further, the actuator could function using a single switch such that as long as the switch is activated the motor output shaft 52 rotates in a first direction to extend or retract the lock of hair 26 until a predetermined limit is reached whereupon the direction of rotation of the motor output shaft 52 is automatically reversed to move the lock of hair 26 in the opposite direction until a second predetermined limit is reached whereupon the direction of rotation of the motor output shaft 52 is again automatically reversed. Other types of proximity switches including but not limited to photocells, can be used.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A toy doll comprising:

a doll head having an aperture extending therethrough;

a doll body supporting the doll head;

a tubular member having a first end extending into the doll head proximate the aperture and a second end extending into the doll body;

a plug member within the tubular member, the plug member being movable toward the first end or toward the second end of the tubular member;

a lock of doll hair secured to the plug member such that at least a portion of the lock of hair extends out of the first end of the tubular member and out of the head aperture;

an electric motor within the doll body, the motor having an output shaft rotatable in first and second directions; and a movement assembly interconnecting the plug member and the output shaft of the motor so that when the output shaft rotates in the first direction the plug member moves toward the first end of the tubular member to move a length of the lock of hair out of the head aperture and when the output shaft rotates in the second direction the plug member moves toward the second end of the tubular member to withdraw a length of the lock of hair into the head aperture.

2. The toy doll as recited in claim 1, wherein the movement assembly includes a reel member which rotates when the output shaft of the motor rotates and a flexible line at least partially wound on the reel member, at least one end of the flexible line being secured to the plug member.

3. The toy doll as recited in claim 2, wherein a first end of the line is secured to a first side of the plug member and a second end of the line is secured to a second side of the plug member so that when the output shaft and the reel rotates in the first direction the plug member is pulled by the line toward the first end of the tubular member and when the output shaft and the reel rotate in the second direction the plug member is pulled by the line toward the second end of the tubular member.

4. The toy doll as recited in claim 2, wherein flexible line comprises a cable.

5. The toy doll as recited in claim 4, wherein the actuator functions to cause the motor output shaft to rotate in one direction until the plug has moved along the tubular member to a predetermined location and then causes the motor output shaft to rotate in the other direction.

6. The toy doll as recited in claim 1, further including an actuator for controlling the operation of the motor and at least one switch for operating the actuator.

7. The toy doll as recited in claim 6, wherein the actuator functions to control the motor output shaft to rotate as long as the switch is engaged.

8. The toy doll as recited in claim 7, wherein the switch comprises a magnetic reed switch which functions to cause the actuator to operate the motor when a magnet is positioned proximate to the switch.

9. The toy doll as recited in claim 7, wherein the switch comprises a momentary push-button switch which functions to cause the actuator to operate the motor as long as the switch is depressed.

10. The toy doll as recited in claim 1, wherein the plug member is generally cylindrical in shape with an outside surface that movingly engages an inner surface of the tubular member.

11. The toy doll as recited in claim 1, wherein the movement assembly includes a gear train engaged with the output shaft of the motor.

12. A toy doll comprising:

a doll head having an aperture extending thereinto;

a doll body supporting the doll head;

a tube having a first end extending in the doll head from proximate the aperture and a second opposing end in the doll body;

a plug member movable within the tube toward the first end or toward the second end of the tube;

a lock of doll hair secured to the plug member and positioned such that at least a portion of the lock of hair extends out of the first end of the tube and out of the head aperture in any position taken by the plug member in the tube;

an electric motor within one of the doll head and the doll body, the motor having an output shaft rotatable by the motor in first and second directions; and a movement member coupled with the plug member and interposed mechanically between the plug member and the output shaft of the motor such that when the motor rotates the output shaft in the first direction, the movement member moves in response and moves the plug member toward the first end of the tube, so as to move a length of the lock of hair out of the head aperture and, when the motor rotates the output shaft in the second direction, the movement member moves in response and moves the plug member toward the second end of the tube so as to withdraw a length of the lock of hair into the head aperture and the tube.

13. The toy doll of claim 12 wherein the movement member is flexible and further comprising a reel about which at least part of the movement member is wound.

14. A toy doll of claim 13 wherein the movement member is a flexible line.

15. The toy doll of claim 14 wherein at least one end of the flexible line movement member is coupled with the plug member.

16. The toy doll of claim 14 wherein the flexible line movement member is arranged in generally an endless loop secured with the plug member.

17. A toy doll comprising:

a doll figure including a head having an aperture extending thereinto and a doll body supporting the doll head;

a tube having a first end extending in the doll head from proximate the aperture and a second opposing end in the doll figure;

a plug member movable within the tube toward the first end or toward the second end of the tube;

a lock of doll hair secured to the plug member and positioned such that at least a portion of the lock of hair extends out of the first end of the tube and out of the head aperture in any position taken by the plug member in the tube;

an electric motor within the doll figure, the motor having an output shaft rotatable by the motor in first and second directions; and movement means including a movement member coupled with the plug member, the movement means being interposed mechanically between the plug member and the output shaft of the motor for moving the plug member with the movement member toward the first end of the tube when the motor rotates the output shaft in the first direction and for moving the plug member with the movement member toward the second end of the tube when the motor rotates the output shaft in the second direction.

18. The toy doll of claim 17 wherein the movement means includes a reel member driven with the output shaft and the movement member is a flexible line at least partially surrounding the reel member and secured with the plug member.

* * * * *